United States Patent [19]

Watson

[11] 4,367,715

[45] Jan. 11, 1983

[54] DISTRIBUTION INJECTION PUMP FOR DIESEL ENGINES

[75] Inventor: Edwin B. Watson, Farmington Hills, Mich.

[73] Assignee: The Bendix Corporation, Southfield, Mich.

[21] Appl. No.: 217,298

[22] Filed: Dec. 17, 1980

[51] Int. Cl.[3] ..... F02M 37/04

[52] U.S. Cl. ..... 123/458; 123/459; 123/506

[58] Field of Search ..... 123/506, 458, 459, 450; 417/462

[56] References Cited

U.S. PATENT DOCUMENTS

| | | | |
|---|---|---|---|
| 3,485,225 | 12/1969 | Bailey et al. | 123/450 |
| 3,779,225 | 12/1973 | Watson et al. | 123/458 |
| 3,851,635 | 12/1974 | Murtin et al. | 123/458 |
| 3,880,131 | 4/1975 | Twaddell et al. | 123/500 |
| 4,125,104 | 11/1978 | Stein | 123/457 |
| 4,146,003 | 3/1979 | Drori | 417/462 |
| 4,216,752 | 8/1980 | Galan | 123/499 |
| 4,241,714 | 12/1980 | Knape et al. | 123/506 |

FOREIGN PATENT DOCUMENTS

| | | | |
|---|---|---|---|
| 2107371 | 9/1971 | Fed. Rep. of Germany . | |
| 1305930 | 2/1973 | United Kingdom . | |
| 1310386 | 3/1973 | United Kingdom . | |
| 2037365A | 7/1980 | United Kingdom | 123/450 |

*Primary Examiner*—Ira S. Lazarus
*Assistant Examiner*—Magdalen Moy
*Attorney, Agent, or Firm*—James R. Ignatowski; Russel C. Wells

[57] ABSTRACT

A distributor injection pump for diesel engines is disclosed. The pump includes a hydraulically balanced distributor head housing the moving parts of a cam actuated opposed piston injection pump rotatably driven in synchronization of the engine. A single solenoid valve disposed along the spill path of the injection pump controls the timing and duration of the fuel injection pulses generated at each of the pump's distributor output ports.

11 Claims, 12 Drawing Figures

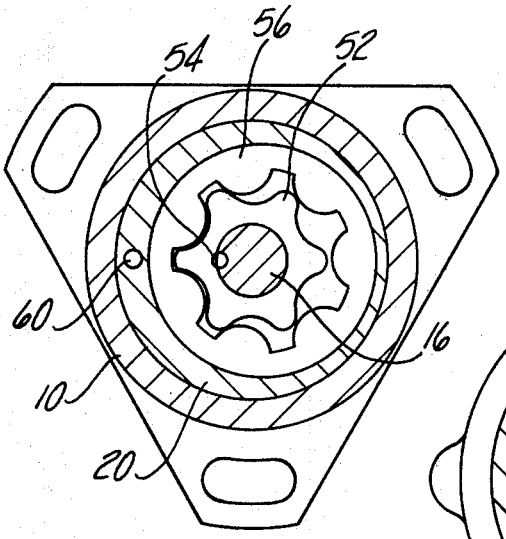
Fig-3
Fig-4
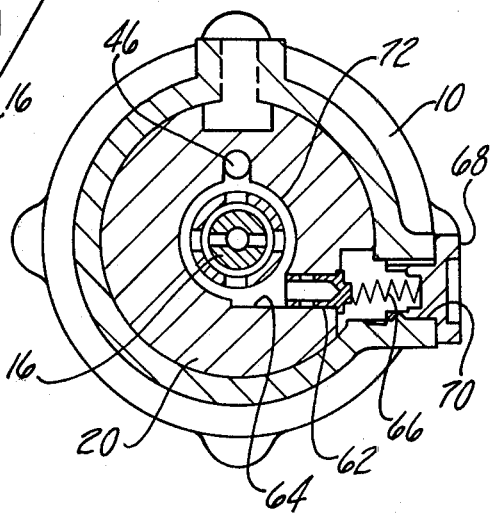
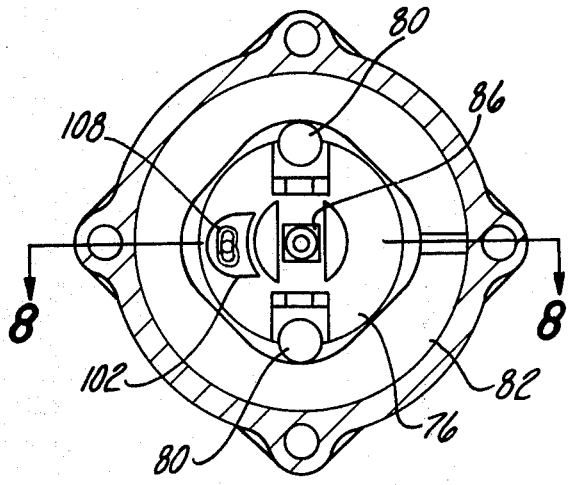
Fig-5
Fig-6
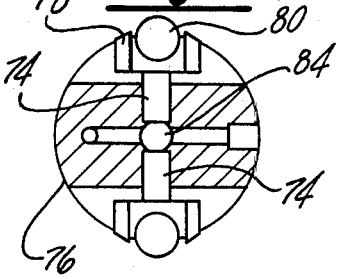
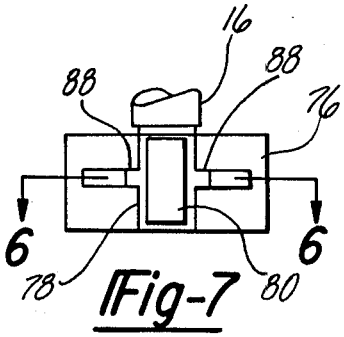
Fig-7

DISTRIBUTION INJECTION PUMP FOR DIESEL ENGINES

CROSS REFERENCE

This application discloses a distributor pump containing structure independently claimed in commonly assigned copending application Ser. No. 217,299 filed on Dec. 17, 1980 concurrently herewith.

BACKGROUND OF THE INVENTION

1. Field of the Invention

The invention is related to the field of fuel injection pumps and in particular to a distributor fuel injection pump in which the period of fuel injection is controlled in response to an electric signal.

2. Prior Art

Distributor fuel injection pumps in which the period of fuel injection is controlled mechanically or hydraulically are well known in the art. The injector pumps disclosed by Stein in U.S. Pat. No. 4,125,104, Sosnowski et al. in U.S. Pat. No. 4,173,959 and Bailey in U.S. Pat. No. 4,200,072, are typical of these types of distributor fuel injector pumps. Recent advances in electronics have resulted in the development of electronic fuel control units which are capable of more accurately computing fuel requirements in response to one or more operational parameters of the engine. These electronic control units are capable of not only computing the required fuel quantity, but also the time at which the fuel is to be injected into the cylinder to optimize the engine's performance. Concurrent with this development has been the development of distributor injection pumps in which the fuel quantity and injection timing are electrically controlled in response to electrical signals generated by electromechanical devices as well as electronic control units. Typical examples of electrically controlled distributor fuel injection pumps are disclosed by Watson et al. in U.S. Pat. Nos. 3,779,225 and 3,859,972 and by Twaddell et al. in U.S. Pat. No. 3,880,131. In U.S. Pat. No. 3,779,225, Watson et al. discloses a distributor injection pump which requires one electrically activated solenoid valve for each output injection port. Alternatively, Watson et al. and Twaddell et al. in U.S. Pat. Nos. 3,859,972 and 3,880,131 disclose injection pumps using two electrically activated solenoid valves. One of the solenoid valves initiates the beginning of the fuel injection pulse and the second terminates the injection pulse. Both solenoid valves act to spill the high pressure injection pulse in its unenergized state.

The disclosed distributor injection pump is an improvement over the injection pumps of the prior art having a single solenoid valve controlling the injection period.

SUMMARY OF THE INVENTION

The invention is a distributor fuel injection pump in which the timing and duration of the generated fuel pulse are controlled by a single solenoid valve in response to electrical signals received from an external source. The pump comprises a charge pump, an injection pump, and a distributor contained within a common housing. A shaft adapted to be rotatably driven by a rotating member of an internal combustion engine actuates the charge and injection pumps and distributor in synchronization with the rotation of the engine. A single normally open solenoid valve disposed along the spill path of the injection pump controls the timing and duration of the fuel injection pulses generated by the injection pump. The distributor sequentially interconnects the output of the injector pump with the output or injector ports of the pump in synchronization with the operation of the engine.

One advantage of the disclosed distributor injection pump is that the time and duration of the fuel injection pulses are controlled by a single solenoid valve. Another advantage of the pump is that the distribution functions are performed mechanically in synchronization with the rotation of the engine. Another advantage of the pump is that the single solenoid valve is energized only during the desired injection period. Still another advantage is that the injection timing is controlled by the electrical signal. These and other advantages of the disclosed electrically actuated distributor fuel injection pump will become apparent from the detailed description of the pump and the apended drawings.

BRIEF DESCRIPTION OF THE DRAWINGS

FIG. 3 is a cross-sectional view showing the details of the charge pump.

FIG. 4 is a cross-sectional view showing the details of the poppet valve.

FIG. 5 is a cross-sectional view showing the details of the distributor head.

FIG. 6 is a cross-sectional view of the distributor head showing the details of the injection pump.

FIG. 7 is a top view of the distributor head showing details of the cam follower.

DETAILED DESCRIPTION OF THE PREFERRED EMBODIMENT

Figure 1:
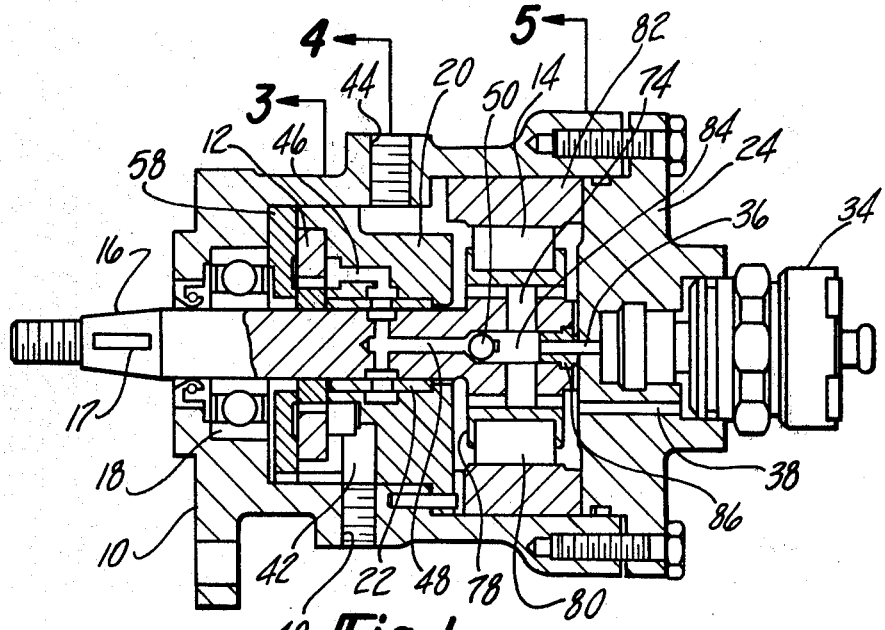
FIG. 1 is a cross-sectional side view of the disclosed pump.
Figure 2:
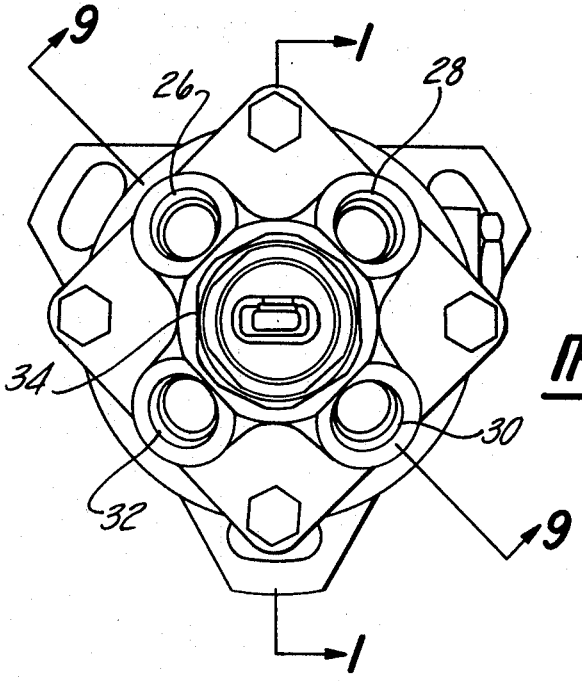
FIG. 2 is an end view of the pump.

FIGS. 1 and 2 are a cross-sectional side view and a front view of a distributor injection pump for a four cylinder diesel engine respectively. Referring first to FIG. 1 the distributor injection pump has a housing 10 enclosing a charge pump 12 and an injection pump 14 connected to a common shaft 16. The shaft 16 is rotatably supported at one end of the housing 10 by a ball bearing 18 and internally within the housing by bearing block 20 and bushing 22. The external end of the shaft 16 has a key 17 to provide proper orientation between the injection pump 14 and the pistons in the engine.

The opposite end of the housing 10 is enclosed by a distributor block 24 having four (4) injection ports 26 through 32 as shown in FIG. 2. A normally open solenoid valve 34 is attached to the distributor block 24 concentric with shaft 16. The input to the solenoid valve is connected to an axially disposed spill port of the injection pump 14 by an inlet bore 36. The outlet of the solenoid valve is connected to the case fluid supply through return bore 38.

The charge pump receives fluid from an external supply through an inlet port 40 passing through the wall of housing 10 and a mating passageway 42 formed in bearing block 20. Case fluid is transmitted back to the external fluid supply through a return port 44. The outlet of the charge pump 12 is connected to the inlet of the injection pump 14 through passageway 46 formed in bearing block 20 and bushing 22 and an axial bore 48 formed through shaft 16. A check valve 50 disposed at the end of axial bore 48 provides for undirectional fluid flow between the charge pump 12 and the injection pump 14.

The charge pump 12 is an internal gear pump of conventional design as illustrated in FIG. 3. The gear pump comprises an inner rotor 52 keyed to shaft 16 by round key 54, and an outer rotor 56. The outer rotor 56 runs in an off-center cylindrical cavity formed in bearing block 20. Inlet ports and outlet ports for the gear pump are formed in the bearing block 20 and matching shadow ports are formed in an opposing port plate 58 as shown in FIG. 1. Bearing block 20 and port plate 58 are held in a fixed non-rotative relationship to housing 10 by a pin 60.

Surplus fluid flow from charge pump 12 is relieved through a charge pump relief valve as shown in FIG. 4. Referring to FIG. 4 the charge pump relief valve comprises a poppet 62 slidably received in bore 64 formed in bearing block 20. Poppet 62 is resiliently retained in bore 64 by a spring 66 disposed between the head of poppet 62 and a cap 68 threadably received in a threaded aperture 70 formed in housing 10. Bore 64 connects to annular cavity 72 formed about the internal diameter of bearing block 20. The fluid output of the charge pump 12 is transmitted to the annular cavity 72 by passageway 46 as shown in FIG. 1.

The injection pump is a cam actuated, opposing piston or plunger pump of conventional design. Referring to FIGS. 1, and 5 through 8 the injection pump comprises a pair of opposing plungers 74 disposed in a diametrical guide bore passing through a distributor head 76 formed at the internal end of shaft 16. The end of each plunger 74 abuts a cam follower comprising a shoe 78 and a roller 80. The roller 80 of the cam follower rolls along the internal surface of a annular cam 82. The internal surface of cam 82 has a plurality of symmetrically disposed lobes equal in number to the number of injection ports of the pump. In the illustrated embodiment cam 82 has four lobes which correspond in number to the four injection ports 26 through 32.

An axial bore 84 formed in the distributor head 76 interconnects the diametrical bore housing plungers 74 with the output of the charge pump 12 through check valve 50, axial bore 48 and interconnecting bore 46. A spill port insert 86 is disposed in the end of axial bore 84 opposite the check valve 50. Insert 86 has an axial spill port connecting bore 84 with the inlet to the solenoid valve 34 through inlet bore 36 formed in distributor block 24.

The shoe 78 of the cam follower may have a pair of wing projections 86 confined by a slot in the distributor head 76 as shown in FIG. 7. The wing projections 88 prevent lateral displacement of the cam followers with the rotation of the distributor head 76.

Figure 8:
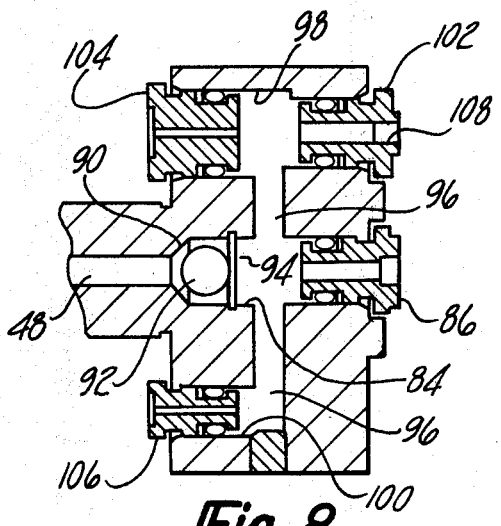
FIG. 8 is an enlarged cross-sectional view of the distributor head showing the details of distributor.

The check valve 50 comprises a valve seat 90 formed at the junction between bores 48 and 84, a ball 92 and a retainer 94 disposed in an annular groove formed in bore 84 as shown in FIG. 8.

The distributor head 76 also includes a second diametrical bore 96 disposed normal to the diametrical guide bore housing plungers 14. Bore 96 interconnects the axial bore 84 with a pair of diametrically opposite insert bores 98 and 100 as shown on FIG. 8. An output insert 102 is disposed in insert bore 98 on the same side of the distributor head as insert 86. A first hydraulic balance insert 104 is disposed in the opposite end of insert bore 98. Insert bore 100 only passes part way through the distributor head 76 and receives a second hydraulic balance insert 106. Inserts 104 and 106 have circular exit apertures and hydraulically balance the forces on the distributor head 76 as shall be described hereinafter. Output insert 102 has a kidney shaped exit aperture 108 forming an output port as shown on FIG. 5. The displacement angle of shaft 16 subtended by the kidney shaped aperture 108 of insert 102 is sufficient to cover all required injection events of the injection pump.

Figure 9:
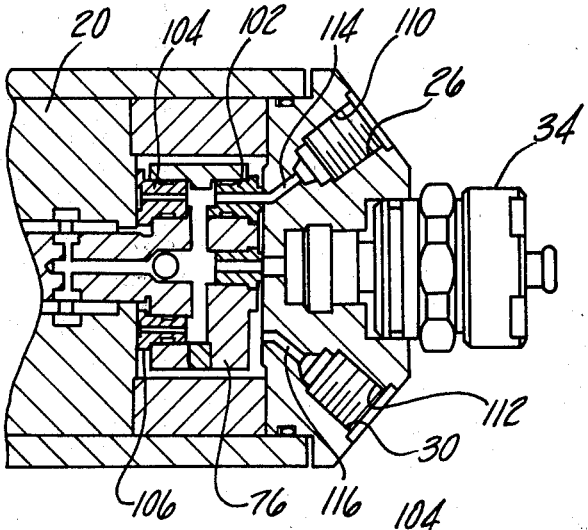
FIG. 9 is a partial cross-sectional view taken through the distributor ports.

Referring now to FIG. 9, there is shown a partial cross-section of the injection pump passing through injection ports 26 and 30. Each of the injection ports has a threaded outlet bore, such as bores 110 and 112, and an elbow shaped passageway, such as passageways 114 and 116, connecting the threaded outlet bores with the injection pump 14 through output insert 102. The ends of the elbow shaped passageways lie on the circumference of a circle defined by the kidney shaped aperture 108 of insert 102 as the distributor head 76 rotates with shaft 16. The apertures of hydraulic balance inserts 104 and 106 are terminated against the adjacent surface of bearing block 20 as shown.

The operation of the injection pump is as follows. The shaft 16 is connected to a rotary member, such as the cam shaft, of an internal combustion engine which rotates at one half the speed of the engine and in synchronization therewith. Key 17 on shaft 16 provides for proper synchronization of the shaft 16 with pistons in the engine.

Rotation of shaft 16 activates the charge pump 12 to provide a fluid flow to injection pump 14 through bores 46, 48 and check valve 50. The fluid being supplied to the injection pump 14 is controlled at an intermediate pressure by poppet valve 62 and spring 66. As the injection pump 14 rotates with shaft 16, the plungers 74 reciprocate in opposing directions producing a fluid flow each time the cam followers encounter a lobe of cam 82. Cam 82 is oriented with respect to the housing 10 and distributor block 24 so that a fluid flow is generated each time the kidney shaped aperture 108 of insert 102 is coincident with the internal end of one of the elbow shaped passageways of the injection ports.

In its unenergized state, the normally open solenoid valve 34 allows the fluid flow generated by the injection pump 14 to be transmitted directly to the case supply through return passageway 38. Energizing solenoid valve 34, blocks this return passageway and the fluid flow is now directed to the injection port having the entrance of its elbow shaped passageway coincident with the kidney shaped aperture 108 of insert 102. In this manner the beginning and end of each fluid flow pulse produced at the individual injection ports of the pump is determined by the electrical signal energizing the solenoid valve 34.

The electrical signals energizing the solenoid valve 34 may be generated by any of the conventional electromechanical and electronic devices known in the art. Typically the electrical signals would be generated by an electronic control unit of any known type which is capable of generating the required electrical signals in response to the operational parameters of the engine. Such electronic control units are capable of computing the time and quantity of fuel to be injected into the engine to optimize its performance under the given operational conditions.

Figure 10:
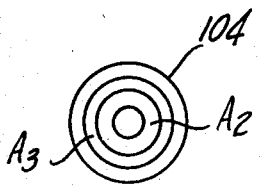
FIGS. 10 and 11 are enlarged end and side views of one of the inserts used to explain the hydraulic balance of the inserts.
Figure 11:
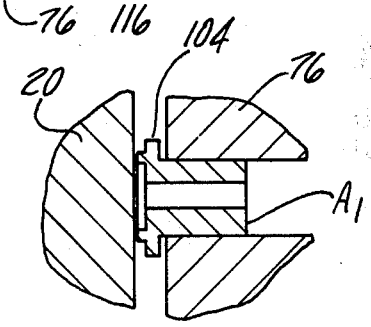

As previously indicated the hydraulic balance inserts 104 and 106 hydraulically balance the forces produced on the distributor head 76 during the generation of a fuel flow by the injection pump. Considering first the balancing of the hydraulic forces acting on each insert. Referring to FIG. 10 and 11 the force $f_1$ urging an insert, such as insert 104, outwardly from the distributor head 76 is the pressure of the fluid P times the surface area $A_1$. The forces $f_2$ and $f_3$ urging the insert back into the distributor head is surface area $A_2$ times the pressure P and surface area $A_3$ times ½ the pressure P where it is assumed the average pressure of the fluid acting between area $A_3$ and surface of the bearing block 20 is one half the difference between the pressure P and the case pressure which is approximately zero. For hydraulic balance of the insert then:

$$f_1=f_2+f_3$$

or $$A_1=A_2+\tfrac{1}{2}A_3$$

Figure 12:
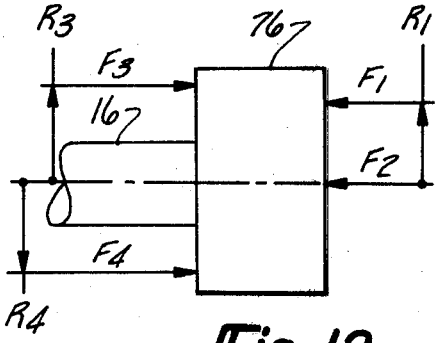
FIG. 12 is a force diagram showing the hydraulic forces on the distributor head during an injection pulse.

The hydraulic forces acting on the distributor head 76 are illustrated in FIG. 12 where $F_1$ is the force produced at the output insert 102, $F_2$ is the force produced at spill insert 86, $F_3$ is the force produced at insert 104 and $F_4$ is the force produced at insert 106. $R_1$, $R_2$, and $R_3$ are the radial distances from the axis of the distributor head where the corresponding forces are applied. For hydraulic balance of the distributor head the following equations for linear forces and rotational torque must be satisfied.

$$F_1+F_2=F_3+F_4\text{—(linear)}$$

and $$F_1R_1=F_3R_3-F_4R_4\text{—(torque)}$$

The parameters $F_1$, $F_2$ and $R_1$ are normally dictated by the mechanical restraints and performance requirements of the pump, therefore the parameters $F_3$, $F_4$, $R_3$ and $R_4$ may be determined by simultaneous solutions of the above two equations.

It is not intended that the invention be limited to the specific embodiment of the distributor injection pump illustrated and described herein. A person skilled in the art may increase the number of injection ports or make other changes to the disclosed pump without departing from the scope and spirit of the invention as set forth in the apended claims.

What is claimed is:

1. A distributor fluid injection pump controlled by electrical signals comprising:

a generally cylindrical housing having an enclosed end and an open end, a shaft aperture passing concentrically through said enclosed end, and an inlet port disposed intermediate said enclosed end and said open end;

a shaft passing through said shaft aperture having a driven end adapted to be rotatably driven external to said housing and an internal portion supported for rotation within said housing, said shaft having a concentric axial bore in said internal portion receiving fluid from said inlet port at one end and forming an axial spill port exiting at the end of the internal portion of said shaft;

injection pump means attached to said shaft intermediate said one end of said axial bore and said spill port for pumping the fluid received at said one end of the axial bore in response to the rotation of said shaft to generate a fluid flow in said internal bore towards the spill port;

a distributor block enclosing the open end of said housing and interfacing the end of the internal portion of said shaft, said distributor block having a return passageway, a spill passageway disposed concentric with said shaft and interconnecting said spill port with said return passageway, and a plurality of injection ports disposed symmetrically around said spill passageway;

distributor means having an outlet port connected to said axial bore for interconnecting said outlet port to said injection ports, one at a time in a repetitive sequence in response to the rotation of said shaft; and a single solenoid valve connected to said distributor block between said spill and return passageways for controlling the fluid flow through said spill passageway in response to electrical signals; said solenoid valve having a first state enabling said fluid flow through said spill passageway to said return passageway and a second state blocking a fluid flow through said spill passageway.

2. The distributor pump of claim 1 wherein said injection pump is a cam actuated opposed piston pump which generates a fluid flow pulse each time said outlet port is interconnected to one of said injection ports.

3. The distributor pump of claim 2 wherein the first state of said solenoid valve means is an unenergized state in response to the absence of an electrical signal and said second state is an energized state in response to an electrical signal.

4. The distributor pump of claim 1 or 3 wherein said housing further includes a return port and a passageway interconnecting said return passageway with said return port.

5. A distributor fuel injection pump for an internal combustion engine having a plurality of cylinders and means for generating electrical signal indicative of the quantity of fuel and the time such quantity of fuel is to be injected into each cylinder, said injection pump comprising:

a generally cylindrical housing having an enclosed end and an open end, a shaft aperature passing concentrically through said enclosed end, and a fuel inlet port disposed intermediate said enclosed end and said open end;

a shaft passing through said shaft aperture having an external end adapted to be rotatably driven by said engine and an internal end supported for rotation in said housing said shaft having an internal axial bore in said internal portion receiving fluid from said inlet port at one end and forming an axial spill port exiting at the internal end of said shaft;

injection pump means attached to said shaft intermediate said one end of said axial bore and the internal end of said shaft for pumping the fuel received at said one end of said axial bore in response to the rotation of said shaft to generate a fuel flow in said axial bore towards said spill port;

a distributor block enclosing the open end of said housing and interfacing the internal end of said shaft, said distributor block having a return passageway, a spill passageway disposed concentric with said shaft and interconnecting said spill port with said return passageway, and a plurality of injection ports, equal in number to the number of cylinders in the engine disposed symmetrically around said spill passageway;

distributor means attached to said shaft adjacent to said distributor block having an outlet port interconnected with said axial bore, said distributor means interconnecting said outlet port with said injection ports, one at a time in a repetitive sequence with the rotation of said shaft; and a single solenoid valve connected between said spill passageway and said return passageway for controlling said fuel flow through said spill passageway in response to said electrical signals, said solenoid valve having a first state enabling said fluid flow through said spill passageway to said return passageway and a second state blocking said fluid flow through said spill passageway.

6. The distributor pump of claim 5 wherein said injector pumping means is a cam actuated opposed piston pump which generates a fluid flow pulse in said axial bore each time said outlet port is interconnected to one of said injection ports.

7. The distributor of claim 5 or 6 wherein the first state of said solenoid valve is an unenergized state in response to the absence of said electrical signal and said second state is an energized state in response to said electrical signal.

8. The distributor pump of claim 5 or 6 wherein said housing includes a return port and a passageway interconnecting said return passageway with said return port.

9. The distributor pump of claim 5 or 6 further including a charge pump actuated by the rotation of said shaft for supplying fuel received at said inlet port to said one end of the axial bore at an increased pressure.

10. A method for generating fuel injection pulses for a multi-cylinder internal combustion engine in response to electrical signals indicative of the engine's fuel requirements, and wherein the internal combustion engine has a rotating output member, comprising the steps of:

rotating a pump shaft in response to the rotation of the engine's rotating output member, said pump shaft having an axial bore connected to a spill passageway disposed concentric with said axial bore;

activating a pump in response to the rotation of said pump shaft to generate a fuel flow in said axial bore;

rotating a distributor in response to the rotation said pump shaft to connect an outlet port interconnected with said axial bore to a plurality of injector ports, one at a time, in a repetitive sequence; and energizing a normally open solenoid valve with the electrical signals to block the fuel flow through said spill passageway connected to the end of said axial bore, thereby causing said fuel to flow through the injector port connected to the pump's outlet port.

11. The method of claim 10 wherein said step of actuating a pump includes the step of generating a fuel flow pulse each time the distributor connects said outlet port with one of said injector ports.

* * * * *